US011761284B2

(12) United States Patent
Baugh

(10) Patent No.: US 11,761,284 B2
(45) Date of Patent: Sep. 19, 2023

(54) METHOD FOR BOP STACK STRUCTURE

(71) Applicant: Benton Frederick Baugh, Houston, TX (US)

(72) Inventor: Benton Frederick Baugh, Houston, TX (US)

( * ) Notice: Subject to any disclaimer, the term of this patent is extended or adjusted under 35 U.S.C. 154(b) by 0 days.

(21) Appl. No.: 17/385,743

(22) Filed: Jul. 26, 2021

(65) Prior Publication Data

US 2023/0028550 A1 Jan. 26, 2023

(51) Int. Cl.
*E21B 33/035* (2006.01)
*E21B 33/064* (2006.01)

(52) U.S. Cl.
CPC ..... *E21B 33/0355* (2013.01); *E21B 33/064* (2013.01)

(58) Field of Classification Search
CPC ..... E21B 33/0355; E21B 33/064
See application file for complete search history.

(56) References Cited

U.S. PATENT DOCUMENTS 4,401,164 A 8/1983 Baugh
6,202,753 B1 3/2001 Baugh
8,602,109 B2 * 12/2013 Gustafson ..... E21B 33/06 166/373
8,833,465 B2 * 9/2014 Kotrla ..... E21B 33/064 166/363
9,222,326 B2 * 12/2015 Whitby ..... E21B 41/0085
9,359,853 B2 * 6/2016 Nas ..... E21B 33/085
9,587,455 B2 * 3/2017 Frey ..... E21B 33/064
9,644,207 B2 5/2017 Baugh
9,797,224 B1 * 10/2017 Stewart ..... E21B 41/0007
10,161,200 B2 * 12/2018 Nunes ..... E21B 15/02
10,577,885 B2 * 3/2020 Drobniak ..... E21B 34/16
2020/0256512 A1 * 8/2020 Mallick ..... F17C 1/06

OTHER PUBLICATIONS

Accumulators, Jan. 2012, Power & Motion, https://www.powermotiontech.com/hydraulics/accumulators/article/21883829/accumulators.*

* cited by examiner

*Primary Examiner* — Aaron L Lembo

(57) ABSTRACT

In a subsea blowout preventer stack system having a structural system and one or more accumulators providing a pressurized hydraulic supply wherein the accumulators comprise a compressed gas supply and a hydraulic fluid chamber in one or more vertical bottles, a method of using the one or more vertical bottles of the accumulators as structural members of the structural system.

11 Claims, 5 Drawing Sheets

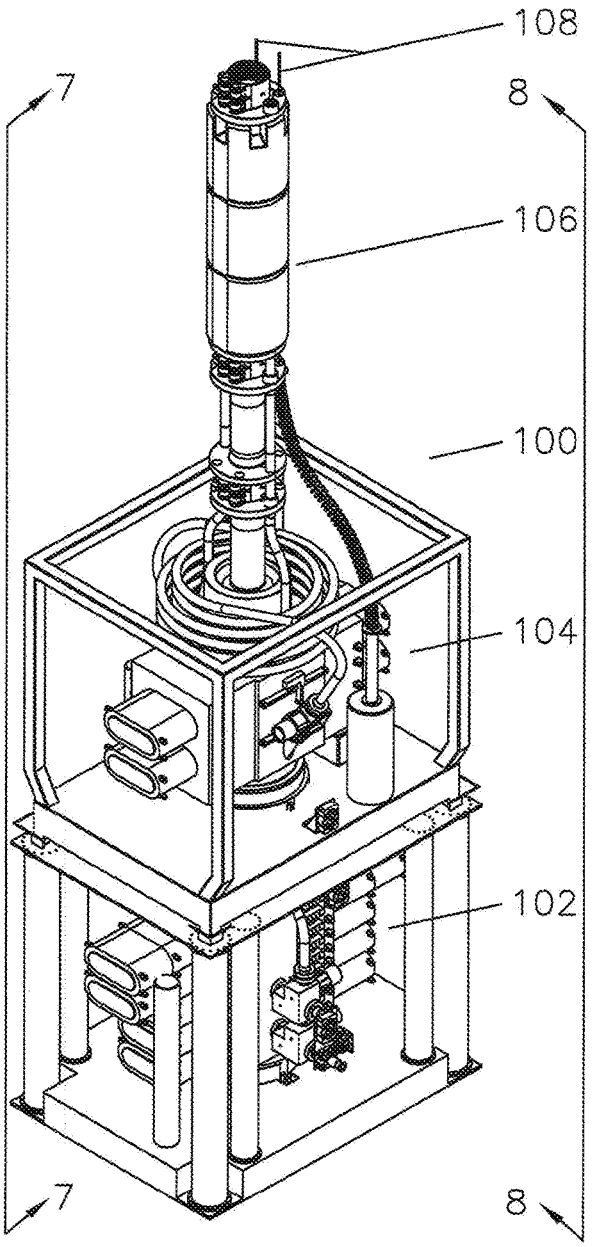
FIG. 2
FIG. 6
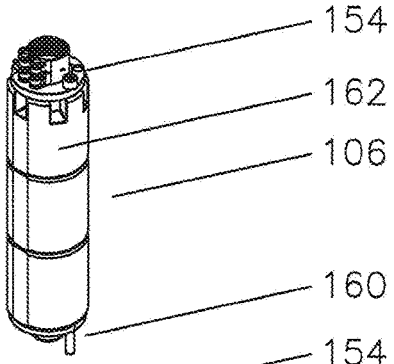
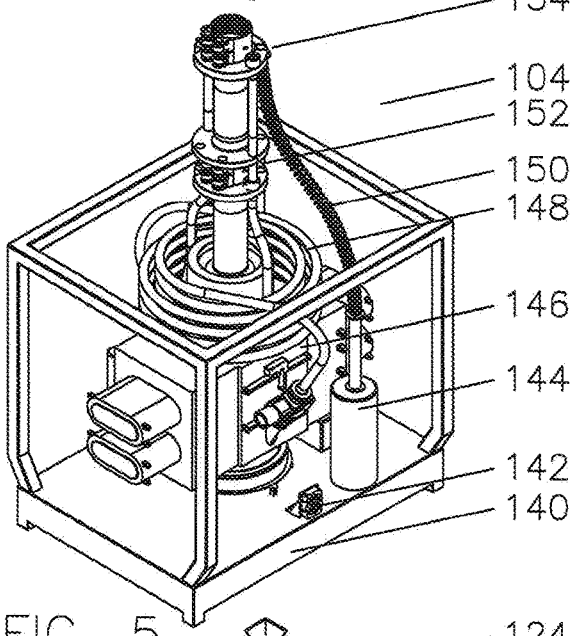
FIG. 5
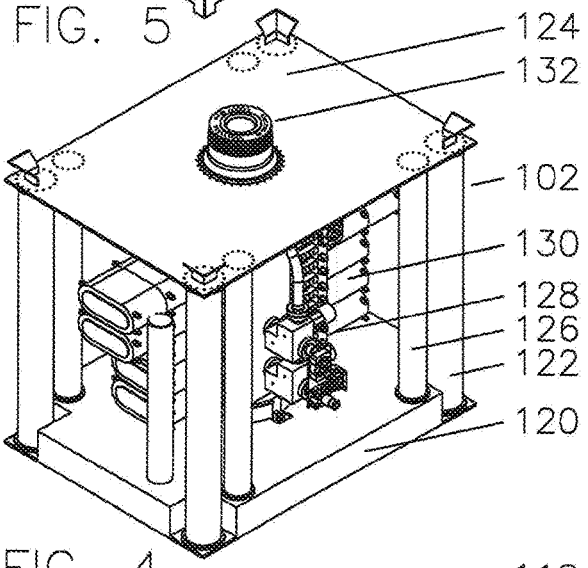
FIG. 4
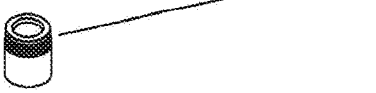
FIG. 3

METHOD FOR BOP STACK STRUCTURE

TECHNICAL FIELD

This invention relates to the method of utilizing the natural strength of accumulator bottles as structural components within the blowout preventer stack structure.

CROSS-REFERENCE TO RELATED APPLICATIONS

Not applicable.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

Deepwater offshore drilling requires that a vessel at the surface be connected through a drilling riser and a large blowout preventer stack to the seafloor wellhead. The seafloor wellhead is the structural anchor piece into the seabed and the basic support for the casing strings which are placed in the well bore as long tubular pressure vessels. During the process of drilling the well, the blowout preventer stack on the top of the subsea wellhead provides the second level of pressure control for the well. The first level being provided by the weighted drilling mud within the bore.

During the drilling process, weighted drilling mud circulates down a string of drill pipe to the drilling bit at the bottom of the hole and back up the annular area between the outside diameter of the drill pipe and the inside diameter of the drilled hole or the casing, depending on the depth.

Coming back up above the blowout preventer stack, the drilling mud will continue to travel back outside the drill pipe and inside the drilling riser, which is much large than the casing. The drilling riser has to be large enough to pass the casing strings run into the well, as well as the casing hangers which will suspend the casing strings. The bore in a contemporary riser will be at least twenty inches in diameter. It additionally has to be pressure competent to handle the pressure of the weighed mud, but does not have the same pressure requirement as the blowout preventer stack itself.

As wells are drilled into progressively deeper and deeper formations, the subsurface pressure and therefore the pressure which the blowout preventer stack must be able to withstand becomes greater and greater. This is the same for drilling on the surface of the land and subsea drilling on the surface of the seafloor. Early subsea blowout preventer stacks were of a 5,000 p.s.i. working pressure, and over time these evolved to 10,000 and 15,000 p.s.i. working pressure. As the working pressure of components becomes higher, the pressure holding components naturally become both heavier and taller. Additionally, in the higher pressure situations, redundant components have been added, again adding to the height. The 15,000 blowout preventer stacks have become in the range of 800,000 lbs. and 80 feet tall. This provides enormous complications on the ability to handle the equipment as well as the loadings on the seafloor wellhead. In addition to the direct weight load on the subsea wellheads, side angle loadings from the drilling riser when the surface vessel drifts off the well centerline are an enormous addition to the stresses on both the subsea wellhead and the seafloor formations.

When the blowout preventer stack working pressure is increased to 20,000 p.s.i. some estimates of the load is that it increases from 800,000 to 1,200,000 lbs. The height also increases, but how much is unclear at this time but it will likely approach 100 feet in height.

There have long been difficulties with overcrowding and congestion within subsea blowout preventer stacks which has even been recently exacerbated by the larger and heavier weight of the pressure containing components as well as increased need for accumulator capacity as greater drilling depths and pressures are encountered.

BRIEF SUMMARY OF THE INVENTION

The object of this invention is to reduce the size, weight, and complexity of subsea blowout preventer stacks.

A second object of this invention is to utilize the strength inherent is high pressure gas bottles as a vertical support means in the blowout preventer structure and thereby eliminating other structural components.

A third object of this invention is to increase the safety and serviceability of the blowout preventer stack by removing the congestion normally associated with accumulators.

Another objective of this invention is to make it safer and more practical to retain the high pressure compressed gas used for accumulators within the tanks which servicing the hydraulic components.

BRIEF DESCRIPTION OF THE DRAWINGS

FIG. 2 is a perspective view of a blowout preventer stack utilizing the features of this invention.

FIG. 3 is a perspective view of a subsea wellhead housing which the blowout preventer stack of this invention would land on.

FIG. 4 is a perspective view of the lower portion of the blowout preventer stack of FIG. 2, generally called the lower BOP stack.

FIG. 5 is a perspective view of the upper portion of the blowout preventer stack of FIG. 2, generally called the lower marine riser package or LMRP.

FIG. 6 is a perspective view of a section of the drilling riser which will be used to lower the blowout preventer stack.

DETAILED DESCRIPTION OF THE INVENTION

Figure 1:
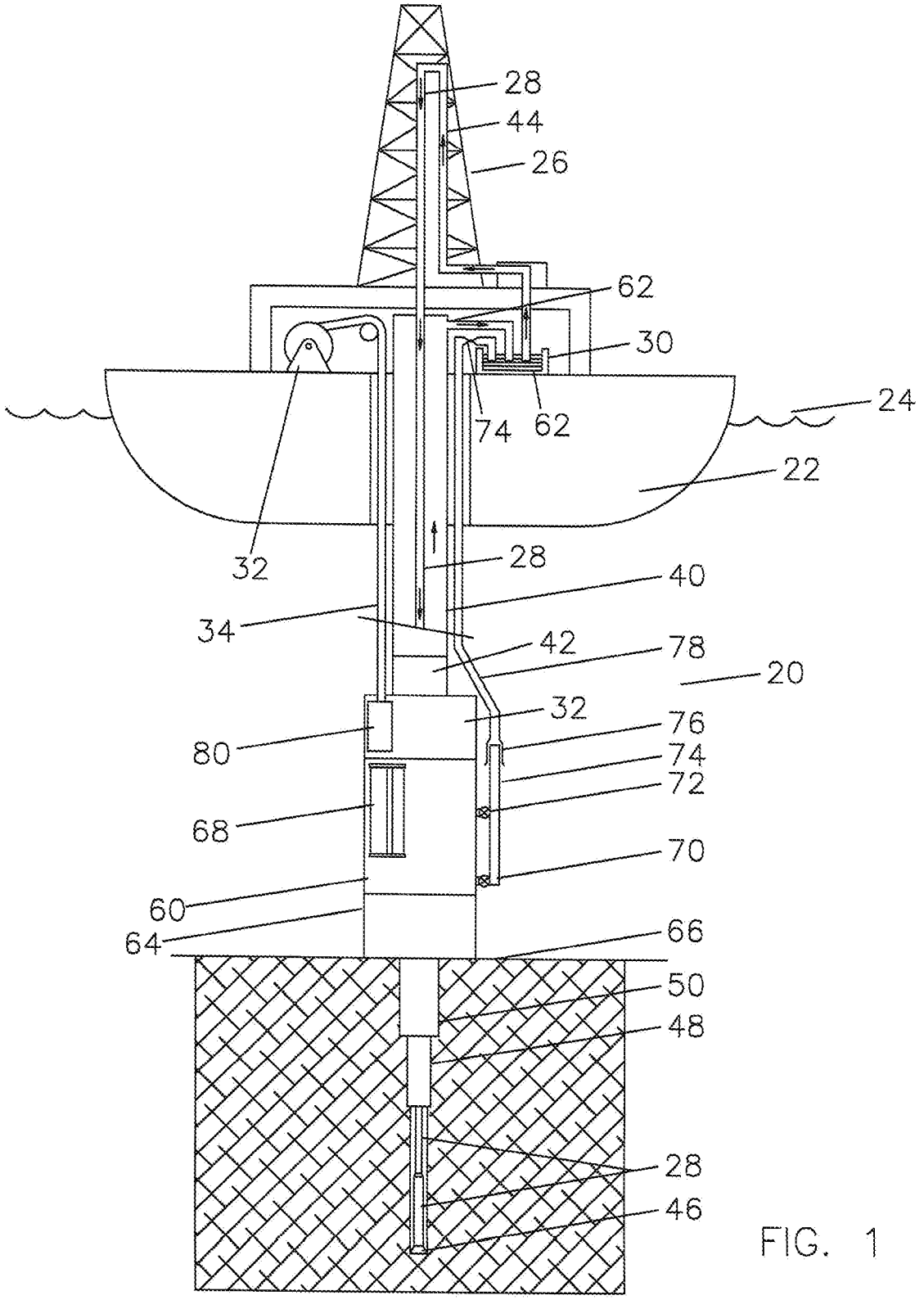
FIG. 1 is a view of a contemporary deep-water riser system.

Referring now to FIG. 1, a view of a system 20 which might use the present invention is shown. It shows a floating vessel 22 on a body of water 24 and having a derrick 26. Drill pipe 28, drilling mud system 30, control reel 32, and control cable 34 are shown. A riser system 40 including a flex joint 42 is shown. During drilling the drilling mud circulated from the drilling mud system 30, up the standpipe 44, down the drill pipe 28, through the drill bit 46, back up through the casing strings 48 and 50, through the blowout preventer stack 60, up thru the riser system 40, and out the bell nipple at 62 back into the mud system 30.

Blowout preventer stack 60 is landed on a subsea wellhead system 64 landed on the seafloor 66. The blowout preventer stack 60 includes pressurized accumulators 68, kill valves 70, choke valves 72, choke and kill lines 74, choke and kill connectors 76, choke and kill flex means 78, and control pods 80.

Referring now to FIG. 2, the seafloor drilling system 100 comprises a lower blowout preventer stack 102, a lower marine riser package 104, a drilling riser joint 106, and control cables 108.

Referring now to FIG. 3, a subsea wellhead is shown which the seafloor drilling system lands on. It is the unseen upper portion of the subsea wellhead system 64 shown in FIG. 1.

Referring now to FIG. 4, the lower blowout preventer stack 102 comprises a lower structural section 120, vertical support bottle 122, and upper structural section 124, accumulators 126, choke and kill valves 128, blowout preventers 130 and an upper mandrel 132 which will be the connection point for the lower marine riser package.

Referring now to FIG. 5 the lower marine riser package 104 is shown comprising a lower marine riser package structure 140, an interface 142 for a remotely controlled vehicle (ROV), annular blowout preventers 146, choke and kill flex loops 148, a flexible passageway 150, a riser connector 152, and an upper half of a riser connector 154.

Referring now to FIG. 6, a drilling riser joint 106 is shown having a lower half of a riser connector 160, a upper half of a riser connector 154, and buoyancy sections 162.

Figure 7:
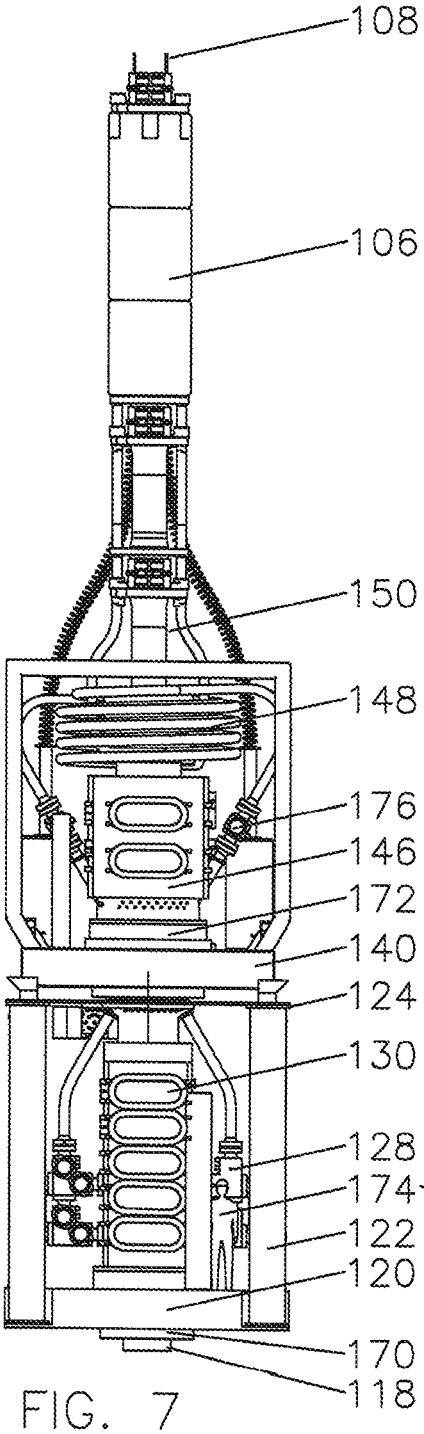
FIG. 7 is a view of the blowout preventer stack of FIG. 2, taken along lines "7-7.

Referring now to FIG. 7, which shows a view of seafloor drilling system 100 taken along lines "7-7" of FIG. 1 showing wellhead connector 170, lower marine riser connector 172, a man 174 for size perspective, and choke and kill valves 176.

Figure 8:
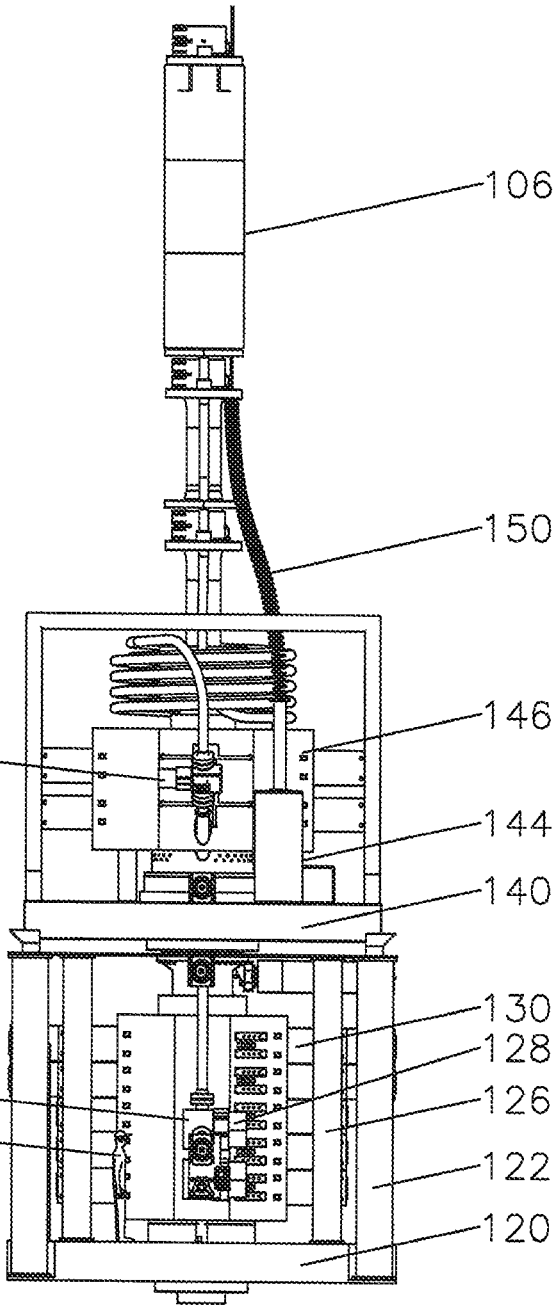
FIG. 8 is a view of the blowout preventer stack of FIG. 2, taken along lines "8-8.

Referring now to FIG. 8, which shows a view of seafloor drilling system 100 taken along lines "8-8" of FIG. 1.

Figure 9:
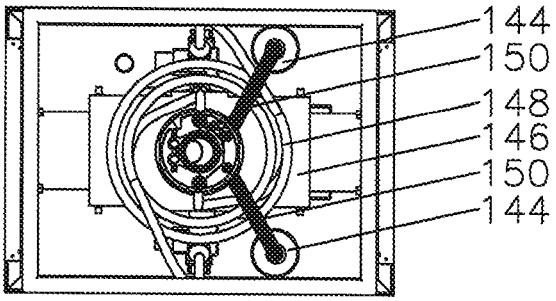
FIG. 9 is a top view of FIG. 8.

Referring now to FIG. 9, which shows a top view of seafloor drilling system 100.

Figure 10:
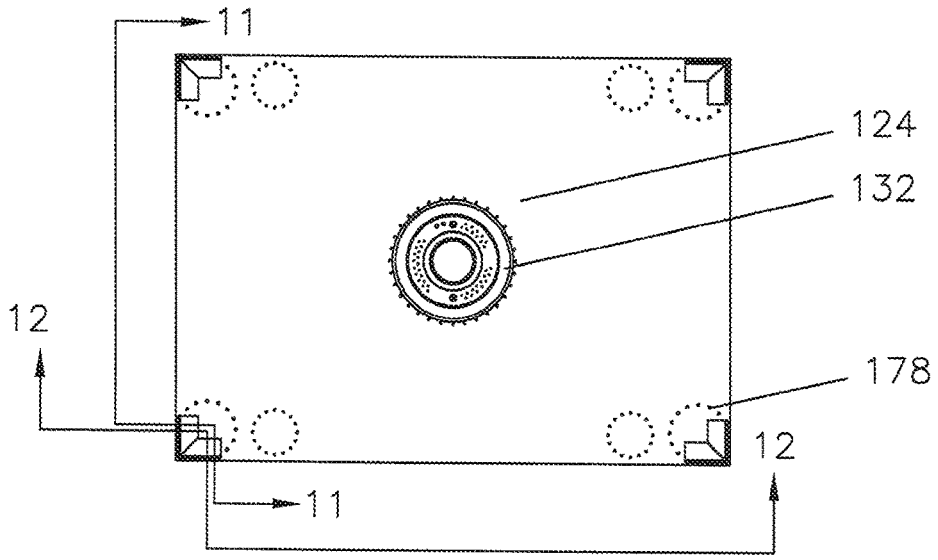
FIG. 10 is a top view of FIG. 4.

Referring now to FIG. 10, which is a top view of FIG. 4, and shows bolting 178 engaging the upper structural section 124.

Figure 11:
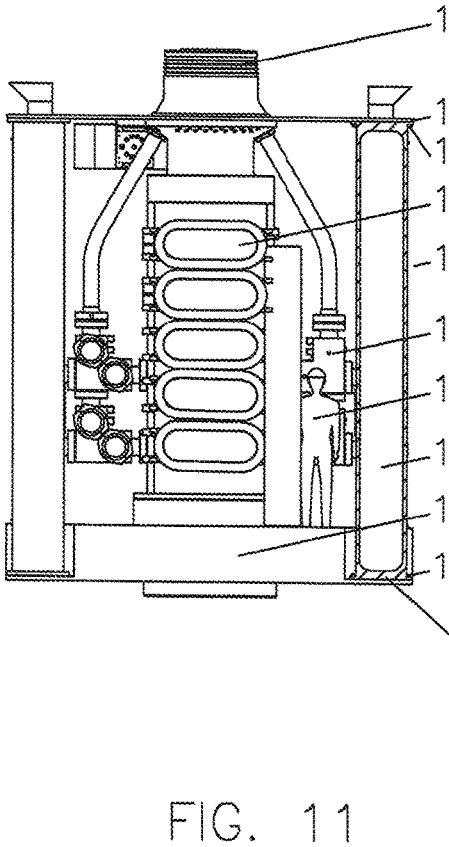
FIG. 11 is a view of FIG. 10 taken along lines "11-11" showing a cutaway section of a vertical support bottle.

Referring now to FIG. 11, which shows a view of the lower blowout preventer stack 102 taken along lines "11-11" of FIG. 10 having the vertical support bottle 122 shown in half section to demonstrate that the tubular support member is actually a gas pressure tank suitable for the dual purpose of both containing a volume of high pressure gas and being a primary structural member for the lower blowout preventer stack.

Figure 12:
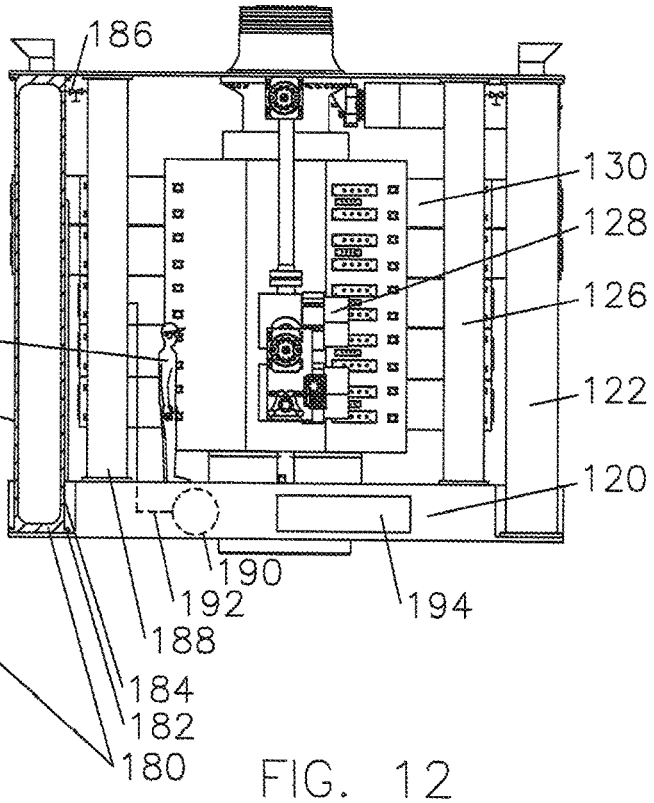
FIG. 12 is a view of FIG. 10 taken along lines "12-12" showing a cutaway section of a vertical support bottle.

Referring now to FIG. 12, which shows a view of the lower blowout preventer stack 102 taken along lines "12-12" of FIG. 10 again having the vertical support bottle 122 shown in half section to demonstrate that the tubular support member is actually a gas pressure tank suitable. Vertical support bottle 122 comprises head member 180, mounting flange 182, and tubular portion 184. Interconnecting valve 186 connects the upper portion of vertical support bottle 122 to the upper portion of hydraulic bottle 188. The combination of vertical support bottle 122 and hydraulic bottle 188 with the interconnecting valve 186 make up the equivalent of a depth compensated accumulator such as is shown in FIG. 2 of U.S. Pat. No. 9,664,207. As the manufacturing cost of large hydraulic cylinders such as this is high, it is cost efficient to put the gas storage area in a lower construction cost gas bottle such as the vertical support bottle of the present invention. In addition to reusing this bottle for primary structure as well as gas storage, the interconnecting valve 186 can be closed when the hydraulic bottle 188 needs to be removed for service. Whereas the depth compensated accumulators greatly reduce the need for accumulator gas supplies, locking the gas in the vertical support bottle 122 reduces the gas need even further. When desired additional guarding can be placed on the outer areas of the vertical support bottle to protect if from accidental damage.

The bladder 160 shown in FIG. 3 of U.S. Pat. No. 9,664,207 to contain a hydraulic fluid for the purpose of safely inputting seawater pressure into the hydraulic bottle is shown as bladder 190 buried with the structure 120 with interconnecting line 192. In placing the bladder hidden within the structure it further relieves the congestion in the primary working area of the lower blowout preventer stack.

Figure 13:
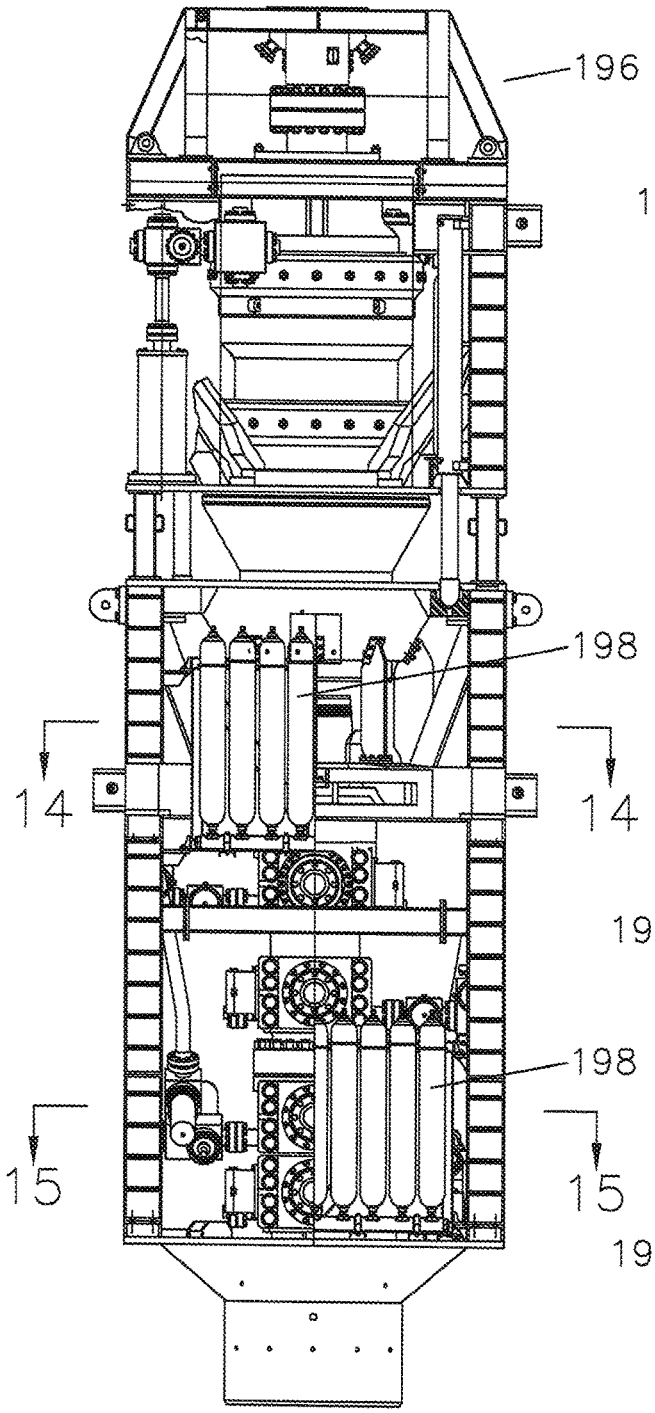
FIG. 13 PRIOR ART
FIG. 13 is a view of a conventional subsea blowout preventer stack with some of the accumulators removed for clarity.

Referring now to FIG. 13 which shows a prior art embodiment of a subsea blowout preventer 196 is shown having numerous accumulators 198 installed. As will be seen in FIGS. 14 and 15, a number of the accumulators are not shown so that the viewer can see the blowout preventer stack. In order to have enough accumulator capacity to safely operate the blowout preventer stacks, the accumulators give a lot of congestion to the blowout preventer stack.

Figure 14:
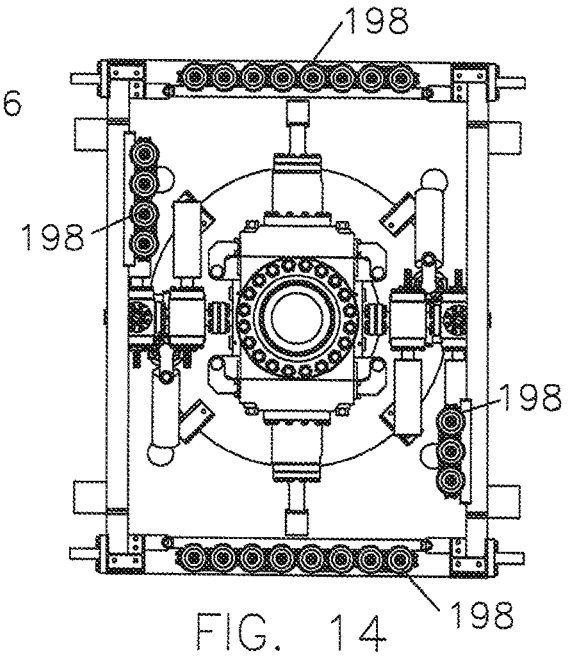
FIG. 14 PRIOR ART
FIG. 14 is a cross section of FIG. 13 taken along lines "14-14" showing the numerous accumulator bottles used and the congestion they cause.

Referring now to FIG. 14, which shows a section of FIG. 13 is shown taken along lines "14-14" showing the full set of accumulators installed, including those not shown in FIG. 13.

Figure 15:
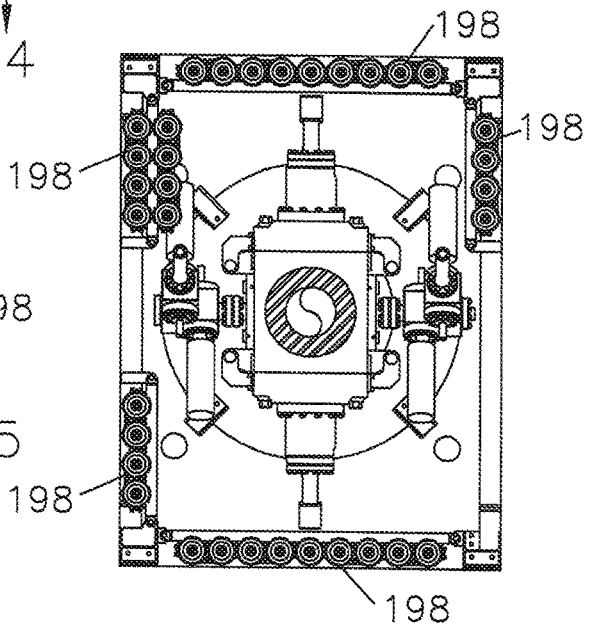
FIG. 15 PRIOR ART
FIG. 15 is a cross section of FIG. 13 taken along lines "15-15" showing the numerous accumulator bottles used and the congestion they cause.

Referring now to FIG. 15, which shows a section of FIG. 13 is shown taken along lines "15-15" showing the full set of accumulators installed, including those not shown in FIG. 13.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

Sequence Listing: N/A

That which is claimed is:

1. In a subsea blowout preventer stack system having a structural system and one or more accumulators providing a pressurized hydraulic supply wherein the accumulators comprise a compressed gas supply and a hydraulic fluid chamber in one or more vertical bottles, a method of using the one or more vertical bottles of the accumulators as vertical structural members of the structural system.

2. The invention of claim 1, further comprising that the portion of said accumulator used as the structural member of the structural system is one or more vertical bottles used for the compressed gas supply.

3. The invention of claim 2, further comprising providing a valve between the one or more vertical bottles used for the compressed gas supply and one or more bottles used for the hydraulic fluid chamber such that the compressed gas can be retained within the one or more vertical bottles used for the compressed gas supply while the one or more bottles used for the hydraulic fluid chamber can be removed for servicing while leaving the one or more bottles for compressed gas supply in place for structural support.

4. The invention of claim 1, further comprising that the portion of said accumulator used as the structural member of the structural system is one or more bottles used for hydraulic fluid chamber.

5. The invention of claim 4, further comprising providing a valve between the one or more bottles used for compressed gas supply and the one or more bottles used for hydraulic fluid chamber such that the hydraulic fluid can be retained within the one or more bottles used for hydraulic fluid chamber while the one or more bottles used for compressed gas supply can be removed for servicing while leaving the one or more bottles for hydraulic fluid chamber in place for structural support.

6. The invention of claim 1, further comprising placing a bladder for inputting depth compensating seawater pressure into the one or more accumulators within structural recesses of the structural system.

7. In a subsea blowout preventer stack system having a structural system comprising a lower structural section and an upper structural section and one or more accumulators providing a pressurized hydraulic supply wherein the accumulators comprise a compressed gas supply and a hydraulic fluid chamber in one or more vertical bottles, a method comprising: using the one or more vertical bottles of the accumulators as vertical structural members of the structural system.

8. The invention of claim 7, further comprising the one or more vertical bottles of the accumulators as structural members of the structural system connecting the lower structural section to the upper structural section.

9. The invention of claim 8, further comprising the connection to the lower structural section is a bolting pattern on the lower end of the one or more vertical bottles.

10. The invention of claim 8, further comprising the connection to the upper structural section is a bolting pattern on the upper end of the one or more vertical bottles.

11. The invention of claim 7, further comprising: wherein the lower structural section comprises structural recesses; and a bladder for inputting depth compensating seawater pressure into the one or more accumulators is placed within the structural recesses.

* * * * *